US009074272B2

(12) United States Patent
Akamizu et al.

(10) Patent No.: US 9,074,272 B2
(45) Date of Patent: Jul. 7, 2015

(54) HIGH-STRENGTH COLD-ROLLED STEEL SHEET EXCELLENT IN UNIFORM ELONGATION AND METHOD FOR MANUFACTURING SAME

(75) Inventors: Hiroshi Akamizu, Kakogawa (JP); Yoichi Mukai, Kakogawa (JP); Shushi Ikeda, Kobe (JP); Koichi Sugimoto, Nagano (JP)

(73) Assignee: Kobe Steel, Ltd., Kobe-shi (JP)

( * ) Notice: Subject to any disclaimer, the term of this patent is extended or adjusted under 35 U.S.C. 154(b) by 869 days.

(21) Appl. No.: 11/910,029

(22) PCT Filed: Mar. 28, 2006

(86) PCT No.: PCT/JP2006/306293

§ 371 (c)(1),
(2), (4) Date: Sep. 28, 2007

(87) PCT Pub. No.: WO2006/106668

PCT Pub. Date: Oct. 12, 2006

(65) Prior Publication Data

US 2008/0251160 A1 Oct. 16, 2008

(30) Foreign Application Priority Data

Mar. 30, 2005 (JP) ..... 2005-098953

(51) Int. Cl.
*C22C 38/04* (2006.01)
*C22C 38/02* (2006.01)
*C21D 8/02* (2006.01)

(52) U.S. Cl.
CPC ..... *C22C 38/04* (2013.01); *C21D 8/0236* (2013.01); *C21D 2211/001* (2013.01); *C21D 2211/002* (2013.01); *C21D 2211/005* (2013.01); *C22C 38/02* (2013.01)

(58) Field of Classification Search
CPC ..... C22C 3/04
USPC ..... 148/652
See application file for complete search history.

(56) References Cited

U.S. PATENT DOCUMENTS

| | | | | |
|---|---|---|---|---|
| 4,426,235 | A * | 1/1984 | Sudo et al. | 148/652 |
| 5,030,298 | A * | 7/1991 | Kawano et al. | 148/602 |
| 6,280,538 | B1 | 8/2001 | Soshiroda et al. | |
| 6,306,527 | B1 | 10/2001 | Ikeda et al. | |
| 7,008,488 | B2 | 3/2006 | Akamizu et al. | |
| 7,090,731 | B2 | 8/2006 | Kashima et al. | |
| 2003/0084966 | A1 | 5/2003 | Ikeda et al. | |
| 2004/0035500 | A1 | 2/2004 | Ikeda et al. | |
| 2004/0159373 | A1 | 8/2004 | Ikeda et al. | |
| 2004/0226635 | A1 | 11/2004 | Ikeda et al. | |
| 2005/0150580 | A1 | 7/2005 | Akamizu et al. | |
| 2005/0161134 | A1 | 7/2005 | Ikeda et al. | |
| 2005/0167007 | A1 | 8/2005 | Miura et al. | |
| 2005/0247378 | A1 | 11/2005 | Ikeda et al. | |
| 2006/0130937 | A1 | 6/2006 | Ikeda et al. | |
| 2006/0137768 | A1 | 6/2006 | Yuse et al. | |
| 2006/0137769 | A1 | 6/2006 | Yuse et al. | |
| 2006/0169366 | A1 | 8/2006 | Yuse et al. | |
| 2006/0169367 | A1 | 8/2006 | Yuse et al. | |
| 2007/0023113 | A1 | 2/2007 | Ikeda et al. | |

FOREIGN PATENT DOCUMENTS

| | | | | |
|---|---|---|---|---|
| CA | 2224813 | A1 * | 1/1997 | C21D 8/02 |
| EP | 0 952 235 | A1 | 10/1999 | |
| EP | 1 391 526 | A2 | 2/2004 | |
| EP | 1 391 526 | A3 | 2/2004 | |
| EP | 1 553 202 | A1 | 7/2005 | |
| JP | 4-333524 | | 11/1992 | |
| JP | 5-186824 | | 7/1993 | |
| JP | 2658706 | | 9/1997 | |
| JP | 3288424 | | 6/2002 | |
| JP | 3317303 | | 8/2002 | |
| JP | 2003-193193 | | 7/2003 | |
| JP | 2004-300452 | | 10/2004 | |
| JP | 2004-332099 | | 11/2004 | |
| JP | 3619357 | | 2/2005 | |

OTHER PUBLICATIONS

H.B. Ryu et al., "Effect of Thermomechanical Processing on the Retained Austenite Content in a Si—Mn Transformation-Induced-Plasticity Steel," Metallurgical and Materials Transactions A, vol. 33A, September 2002—2811-2816.*
Machine translation of JP2004332099 (Japanese document published Nov. 25, 2004).*
Yamada, Toshiro, et al., "The Mixed Structure with Bainite and Retained Austenite in a Si—Mn Steel -I-", Nisshin Steel Technical Report, No. 43, pp. 1-10, Dec. 1980.
U.S. Appl. No. 12/477,299, filed Jun. 3, 2009, Ikeda, et al.
U.S. Appl. No. 12/162,878, filed Jul. 31, 2008, Mukai et al.
U.S. Appl. No. 11/910,013, filed Sep. 28, 2007, Kashima ,et al.
U.S. Appl. No. 11/874,516, filed Oct. 18, 2007, Ikeda, et al.
I. B. Timokhina, P. D., et al., "Effect of Deformation Schedule on the Microstructure and Mechanical Properties of a Thermoechanically Processed C—Mn—Si Transformation-Induced Plasticity Steel", Metallurgical and Materials Transactions A, vol. 34A, XP002584715, Aug. 2003, pp. 1599-1609 (with English Abstract).
Bevis Hutchinson, et al., "Texture in Hot Rolled Austenite and Resulting Transformation Products", Materials Science and Engineering A, vol. 257, No. 1, XP005495440, Nov. 30, 1998, pp. 9-17.
Supplementary European Search Report issued Aug. 3, 2010 in European Patent Application No. 06730241.4.
U.S. Appl. No. 12/303,566, filed Dec. 5, 2008, Nakaya, et al.
U.S. Appl. No. 12/303,634, filed Dec. 5, 2008, Nakaya, et al.
U.S. Appl. No. 12/305,998, filed Dec. 22, 2008, Saito, et al.
Office Action issued Apr. 26, 2013 in European Application No. 06 730 241.4.

* cited by examiner

*Primary Examiner* — Stanley Silverman
*Assistant Examiner* — Christopher Kessler
(74) *Attorney, Agent, or Firm* — Oblon, McClelland, Maier & Neustadt, L.L.P.

(57) ABSTRACT

A high-strength cold-rolled steel sheet excellent in uniform elongation, including in percent by mass:
0.10-0.28% of C;
1.0-2.0% of Si; and
1.0-3.0% of Mn,
and the structures of the same having the space factors below to the entire structure:
30-65% of bainitic ferrite;
30-50% of polygonal ferrite; and
5-20% of residual austenite.

15 Claims, No Drawings

HIGH-STRENGTH COLD-ROLLED STEEL SHEET EXCELLENT IN UNIFORM ELONGATION AND METHOD FOR MANUFACTURING SAME

TECHNICAL FIELD

The present invention relates to a high-strength cold-rolled steel sheet with excellent uniform elongation and a method of manufacturing the same, and more particularly, to a high-strength cold-rolled steel sheet exhibiting an excellent balance between its tensile strength and its elongation (i.e., total elongation) as well as an excellent balance between its tensile strength and its uniform elongation and a useful method of manufacturing such a steel sheet. Specifically, a high-strength cold-rolled steel sheet according to the present invention has the product of tensile strength [TS (Mpa)] and elongation [EL (%)] of 23000 or more and the product of tensile strength (TS) [TS (Mpa)] and uniform elongation [u-EL (%)] of 14700 or more. The steel sheet according to the present invention should find an effective use in a wide spectrum of industrial fields including the automobile industry, the electric industry and the machinery industry, from among which use for a car body will be mainly described as a representative application below.

BACKGROUND ART

High-tensile steel which is more highly strong and highly ductile is demanded for the purpose of securing car crash safety and a weight reduction of an automobile both at a high level. As framework parts and components of a car body in particular become thinner, car crash safety based on an improved strength is increasingly important.

To be particularly noted these days is accelerated promotion of a weight reduction based on use of high-tensile steel in an attempt to meet the COP3 requirement (International Conference on the Prevention of Global Warming of 1997), emission control regulations (becoming effective in 2008 in Europe and in 2009 in Japan). Further, with tightening of regulations regarding a crash to the side sections of a car (including tightening of the US Safety Standard in 2005 for instance), the demand is rising for steel which is more highly tensile (e.g., super-high-tensile steel whose tensile strength TS is 780 MPa or greater). A high-strength steel sheet nevertheless must also be excellent in formability: for various applications, appropriate formability is required.

However, members, pillars and the like affecting car crash safety for instance among parts and components which are used in a car body have particularly complex shapes, which leaves a problem that it is not possible to ensure proper formability with the mechanical properties (such as TS×EL=14700 MPa·% where the tensile strength TS is 980 MPa and the elongation EL is 15%) of conventional DP steel (Dual-phase steel).

Meanwhile, TRIP (Transformation Induced Plasticity) steel sheets are gaining a renewed attention as high-strength steel sheets which are excellent in elongation. A TRIP steel sheet is a steel sheet in which an austenite structure remains present and which significantly elongates as the residual austenite ($\gamma_R$) is induced to transform into martensite due to stress when processed and deformed at a temperature equal to or higher than the martensitic transformation start temperature (Ms point). Known as such includes TRIP-type complex-structure steel (TPF steel) whose main phase is polygonal ferrite and which contains residual austenite, TRIP-type bainitic steel (TBF steel) whose mother phase is bainitic ferrite and which contains residual austenite, etc.

Of these, TBF steel has long been known (NISSHIN STEEL TECHNICAL REPORT, No. 43, December 1980, pp. 1-10) and makes it easy to attain a high strength because of its hard bainitic structure. It is characterized in exhibiting extremely favorable elongation (total elongation) since very fine residual austenite tends to be created at the boundary of lath bainitic ferrite in the bainitic structure. Another advantage of TBF steel is an advantage related to manufacturing that TBF steel is easily produced through one thermal processing (continuous annealing or plating).

However, although being excellent in total elongation (EL), conventional TBF steel is not yet satisfactory with respect to uniform elongation. Although the uniform elongation (u-EL), which is important to improve the punch stretch formability, needs be excellent particularly in the case of members, pillars and the like mentioned above which are components requiring stretch forming, TBF steel proposed so far does not have excellent uniform elongation, and therefore, there is a serious need for a further improvement of this characteristic.

DISCLOSURE OF INVENTION

The present invention has been made under this circumstance, and accordingly, an object of the present invention is to provide a high-strength cold-rolled steel sheet which exhibits an excellent balance between its tensile strength and its elongation as well as an excellent balance between its tensile strength and its uniform elongation and which is optimal as the material of automotive members, pillars and the like which require stretch forming, and to provide a useful method of manufacturing such a high-strength steel sheet.

The high-strength cold-rolled steel sheet according to the present invention which is excellent in formability contains in percent by mass (as generally applied to any chemical component below):

0.10-0.28% of C;
1.0-2.0% of Si; and
1.0-3.0% of Mn, and in the structure of the high-strength cold-rolled steel sheet, bainitic ferrite accounts for 30-65%,
polygonal ferrite accounts for 30-50%, and
residual austenite accounts for 5-20%
each in terms of space factor to the entire structure.

When necessary, the high-strength cold-rolled steel sheet according to the present invention may further contain for usefulness: (a) at least one element selected from a group consisting of 0.10% or less (not including 0%) of Nb, 1.0% or less (not including 0%) of Me, 0.5% or less (not including 0%) of Ni and 0.5% or less (not including 0%) of Cu; (b) 0.003% or less (not including 0%) of Ca and/or 0.003% or less (not including 0%) of REM; (c) 0.1% or less (not including 0%) of Ti and/or 0.1% or less (not including 0%) of V; and the like, and the characteristics of the cold-rolled steel sheet further improve depending upon the types of the contained elements. Further, the present invention encompasses, besides the cold-rolled steel sheet above, a plated steel sheet as well which is obtained by plating the cold-rolled steel sheet.

Meanwhile, as for manufacture of the cold-rolled steel sheet according to the present invention, the steel sheet as it is after hot rolling and cold rolling may be heated up to a temperature equal to or higher than the $A_3$ transformation point ($A_3$) for soaking, thereafter temporarily cooled down to a temperature Tq expressed by the formula (1) below at an average cooling rate of 1-10° C./sec, and then quenched from this temperature down into a bainitic transformation temperature range at an average cooling rate of 11° C./sec or faster:

$$A_3-250(^\circ\text{ C.})\leq Tq\leq A_3-20(^\circ\text{ C.}) \quad (1)$$

According to the present invention, it is possible to provide a high-strength rolled steel sheet on which the product of the tensile strength [TS (MPa)] and elongation [EL (%)] is 23000 or more and the product of the tensile strength (TS) [TS (Mpa)] and the uniform elongation [u-EL (%)] is 14700 or more and which exhibits an extremely excellent balance between its tensile strength and its elongation as well as an extremely excellent balance between its tensile strength and its uniform elongation. Such a steel sheet is extremely useful particularly to manufacture of automotive parts and components and other industrial parts and components which demand a high strength and uniform elongation, and favorable stretch forming is possible on such a steel sheet.

BEST MODE FOR CARRYING OUT THE INVENTION

In an effort to provide a high-strength rolled steel sheet and a plated steel sheet which are extremely excellent in terms of a balance between the tensile strength and the elongation as well as a balance between the tensile strength and the uniform elongation, the inventors of the present invention have been studying TBF steel in particular. While the present invention focuses on TBF steel because it basically exhibits an excellent balance between its tensile strength and its elongation, the reason of the specific focus on a cold-rolled steel sheet in particular among steel sheets is consideration of the fact that despite a very strong demand to a cold-rolled steel sheet for use as a car body and the like owing to a thinner sheet thickness of a cold-rolled steel sheet than the thickness of a hot-rolled steel sheet, a high accuracy of securing a surface quality, etc., a cold-rolled steel sheet tends to be inferior with respect to elongation, uniform elongation and the like to a hot-rolled steel sheet due to its thinner sheet thickness and hence no cold-rolled steel sheet excellent also in workability has been made available.

While the mother-phase structure of TBF steel is bainitic ferrite, since bainitic ferrite, due to its high initial dislocation density, is not proper in ensuring plastic deformation although it easily provides a high strength, it is difficult to ensure significant uniform elongation. Meanwhile, TRIP-type complex-structure steel (TPF steel) whose main phase is polygonal ferrite and which contains residual austenite, despite the contained polygonal ferrite which exhibits good plastic deformation, has a low dislocation density and therefore does not make it possible to attain a high strength.

In light of this, the inventors of the present invention have found from this that if the synergy effect is secured between transformation induced plasticity attained by residual austenite (residual γ) and use of polygonal ferrite in TBF steel, a dramatic improvement of uniform elongation of TBF steel would be attained which would realize a high-strength cold-rolled steel sheet excellent in uniform elongation, thus completing the present invention.

The steel sheet according to the present invention has a mixed structure of bainitic ferrite and polygonal ferrite with the content of polygonal ferrite staying within a predetermined volume range, and accordingly exhibits enhanced uniform elongation. The characteristics related to the structure of the steel sheet according to the present invention will now be described.

[Bainitic Ferrite: 30-65%]

The steel sheet according to the present invention contains residual austenite which will be described later as a second-phase structure, and its mother-phase structure is a mixed structure of bainitic ferrite and polygonal ferrite.

Bainitic ferrite in the present invention is clearly differentiated from a bainite structure in that it does not contain carbides within the structure. In addition, while being plate-like ferrite, bainitic ferrite means a substructure whose dislocation density is high (which may or may not include a lath-like structure) and is different also from a polygonal ferrite structure which includes a substructure whose dislocation density is zero or extremely low or a quasi-polygonal ferrite structure which includes a substructure which is fine sub grains or the like ("Photo Collection of Bainite in Steel—1", Basic Research Group, Iron and Steel Institute of Japan). Bainitic ferrite and polygonal ferrite are clearly distinguished from each other as described below based on observation with SEM.

Polygonal ferrite: In a SEM picture, it shows black, has polygonal shapes, but does not contain residual austenite or martensite.

Bainitic ferrite: It shows dark gray in a SEM picture, and cannot be often separated and distinguished from residual austenite or martensite.

The mixed structure of bainitic ferrite and polygonal ferrite, which is a principal structure of the steel sheet according to the present invention, can easily have an enhanced strength due to its bainitic ferrite whose dislocation density (initial dislocation density) is high to a certain extent and can exhibit excellent uniform elongation due to its polygonal ferrite.

It is necessary for bainitic ferrite to have a space factor of 30% (in terms of area %) to the entire structure in order to effectively exhibit its function described above. The space factor is preferably 35% or more, and more preferably, 40% or more. However, if the space factor of bainitic ferrite exceeds 65%, polygonal ferrite becomes accordingly less and uniform elongation becomes less.

[Polygonal Ferrite: 30-50%]

As described above, the steel sheet according to the present invention exhibits improved uniform elongation owing to a certain level of rich generation of polygonal ferrite, and for the purpose of ensuring this effect, it is necessary that the space factor of polygonal ferrite is 30% (area %) or more. The space factor of polygonal ferrite is preferably 32% or more, and more preferably, 34% or more. However, if this space factor is too high, the space factor of bainitic ferrite accordingly becomes less and the strength of the steel sheet decreases. While a method of increasing the space factor of polygonal ferrite will be described later, polygonal ferrite obtained in accordance with this method, when observed with SEM or an optical microscope (repeller corrosion), the morphological structure is an elongated one along an equiaxial direction (whereas the morphological structure of conventional TRIP steel sheet elongates along a rolling direction). This morphological structure is considered to be what it makes it possible to evenly distribute stress during processing and make a maximum use of the TRIP effect owing to the residual amount γ. Further, the reason of such a morphologic existence is considered to be because of crystal nucleation from the grain boundary of former austenite created in a high temperature range.

[Residual Austenite (residual γ): 5-20%]

Residual γ is an essential structure for ensuring the TRIP (Transformation Induced Plasticity) effect and useful in improving elongation (total elongation). For this function to be felt effectively, the space factor of residual γ in the entire structure needs be 5% or over. To ensure even better ductility (such as elongation), the space factor is preferably 7% or higher. On the contrary, since an excessive ratio degrades local deformability, the upper limit is 20%. The space factor is more preferably 17% or less.

A further recommendation is that the concentration of C in residual γ ($C\gamma_R$) is 0.8% or higher. $C\gamma_R$ is significantly influential over the TRIP characteristic, and when controlled to be 0.8% or higher, is effective particularly for improvement of elongation, etc. Preferably, $C\gamma_R$ is 1% or higher. Although a greater amount of $C\gamma_R$ is preferable, an adjustable upper limit is generally 1.6% or higher considering an actual operation.

A method of measuring the mother-phase structure (bainitic ferrite, polygonal ferrite) and the second-phase structure (residual γ) which constitute the steel sheet according to the present invention will now be described.

First, the steel sheet is corroded with nital, the parallel surface to a rolling surface is observed with SEM (scanning electron microscope) at a location corresponding to ¼ of the sheet thickness (at the magnification of 4000×), and image processing is performed which yields the area % of polygonal ferrite (PF) and that of other structures (bainitic ferrite+residual γ; which will be hereinafter occasionally referred to as "the non-PF structures") than polygonal ferrite (PF).

Meanwhile, the space factor of residual γ is measured by a saturated magnetization measuring method [JP 2003-90825, A, and Kobe Steel R&D Technical Report, Vol. 52, No. 3 (December 2002)]. The saturated magnetization measuring method is based on the following measurement principles. That is, while structures such as the ferrite phase and the martensite phase in a metal structure exhibit a ferromagnetic property at a room temperature, the austenite phase is paramagnetic. Hence, the saturated magnetization volume (Is) per unit area of a metal structure consisting only of ferromagnetic structures such as the ferrite phase and the martensite phase may be identified in advance and the saturated magnetization volume (I) of a sample containing the austenite phase may be measured, which permits calculation of the proportion (in volume %) of the austenite (γ) phase by the formula (2) below:

$$\gamma(\text{volume }\%)=[1-(I/Is)]\times 100 \quad (2)$$

and the calculation result may be defined as the space factor (area %).

Next, the space factor (area %) of residual γ is subtracted from the area percentage of "the non-PF structures" calculated as described above, whereby the space factor (area %) of bainitic ferrite (BF) is calculated.

As described above, according to the present invention, the mixed structure of bainitic ferrite and polygonal ferrite is used as the mother-phase structure and a predetermined amount of residual γ is included in the mixed structure, thereby obtaining a TRIP steel sheet which serves as a high-strength steel sheet exhibiting improved elongation and total elongation. The following may however be contained as other structures.

[Others: Pearlite, Bainite, Martensite (Including 0%)]

The steel sheet according to the present invention does not entirely preclude inclusion of other structures (pearlite, bainite, martensite, etc.) which may be left present during a manufacturing process according to the present invention. Rather, the present invention encompasses steel sheets containing such other structures only to an extent not detrimental to the function of the present invention. However, the smaller the space factor of such other structures is, the more preferable. It is recommended that the total amount of the other structures to be controlled to 10% or less (more preferably, 5% or less).

Basic components constituting the steel sheet according to the present invention will now be described. The units (in %) for chemical components below are all mass %.

C: 0.10-0.28%

C is an element which is necessary to secure a high strength while maintaining residual γ. In more detailed words, this is an important element to ensure that the γ phase contains a sufficient amount of C so that the γ phase as desired will remain even at a room temperature. For this function to be felt effectively, C needs be contained at 0.10% or more, preferably 0.12% or more, and more preferably 0.15% or more. Considering the weldability however, it is desirable that C is contained at 0.28% or less, preferably 0.25% or less, more preferably 0.23% or less, further preferably 0.20% or less.

Si: 1.0-2.0%

Si is an element which effectively suppresses decomposition of residual γ and generation of carbides and is useful as an element which enhances the solid solubility. For this function to be felt effectively, Si needs be contained at 1.0% or more, preferably 1.2% or more. An excessive content of Si however saturates the effect above and leads to a problem of hot brittleness, etc. The upper limit is therefore 2.0%. Si is preferably 1.8% or less.

Mn: 1.0-3.0%

Mn is an element which is necessary to stabilize γ and obtain desirable residual γ. For this function to be felt effectively, Mn needs be contained at 1.0% or more, preferably 1.3% or more, more preferably 1.6% or more. An excess beyond 3.0% however gives rise to an adverse effect such as a casting crack. Mn is preferably controlled to 2.5% or less.

The steel sheet according to the present invention basically contains the above components, and the remaining part is substantially iron. Raw materials, resources, manufacturing equipment or other factor however may result in inclusion of inevitable impurities which are elements such as N (nitrogen), 0.01% or a smaller amount of 0 (oxygen), 0.5% or a smaller amount of Al, 0.15% or a smaller amount of P and 0.02% or a smaller amount of S, which is permitted. However, as excessive N causes deposition of nitrides in a large volume and may deteriorate the ductility, the amount of N is preferably 0.0060% or less, preferably 0.0050% or less, and more preferably 0.0040% or less. Although the smaller the amount of N in the steel sheet is, the more preferable, the lower limit of the amount of N is around 0.0010% considering a possible operation-induced reduction.

In addition, only to an extent not detrimental to the function of the present invention, positive addition of (a) at least one element selected from a group consisting of Nb, Mo, Ni and Cu; (b) Ca and/or REM; (c) Ti and/or V, and other elements is also useful, and the characteristics of the cold-rolled steel sheet further improve depending upon the types of the contained elements. The reason of limiting the ranges for inclusion of these elements is as described below.

At least one element selected from a group consisting of 0.10% or less (not including 0%) of Nb, 1.0% or less (not including 0%) of Mo, 0.5% or less (not including 0%) of Ni and/or 0.5% or less (not including 0%) of Cu These elements are useful as elements which reinforce steel and are effective in stabilizing residual γ and ensuring the predetermined amount of residual γ. These elements may be each used alone, or two or more types may be used in combination. A recommendation for this to be effective is 0.03% or more (preferably, 0.04% or more) of Nb, 0.05% or more (preferably, 0.1% or more) of Mo, 0.05% or more (preferably, 0.1% or more) of Ni and 0.05% or more (preferably, 0.1% or more) of Cu. Excessive addition however saturates the effect above and is uneconomical, and therefore, the upper limit is 0.10% for Nb, 1.0% for Mo, 0.5% for Ni and 0.5% for Cu. More preferably, Nb is 0.08% or less, Mn is 0.8% or less, Ni is 0.4% or less and Cu is 0.4% or less.

0.003% or less (not including 0%) of Ca and/or 0.003% or less (not including 0%) of REM Ca and REM (rear earth elements) are elements which are effective in controlling the morphology of sulfides in steel and improving the workability, and may each be used alone or in combination. The rear earth elements used in the present invention may be Sc, Y lanthanoid, etc. For this function to be felt effectively, the content of each is preferably 0.0003% or higher (more preferably, 0.0005% or higher). However, excessive addition beyond 0.003% saturates the effect above and is uneconomical. The content is preferably 0.0025% or less.

0.1% or less (not including 0%) of Ti and/or 0.1% or less (not including 0%) of Vi These elements have a precipitation strengthening effect, and as such, are elements which are useful in improving the strength. For this function to be felt effectively, it is recommended to add 0.01% or more of Ti (more preferably, 0.02% or more) and 0.01% or more of V (more preferably, 0.02% or more). However, as for any one of these elements, excessive addition beyond 0.1% saturates the effect above and is uneconomical. Ti is therefore preferably 0.08% or less, and V is therefore preferably 0.08% or less.

A method of manufacturing the cold-rolled steel sheet according to the present invention will now be described. The manufacturing method according to the present invention requires execution of a hot rolling step, a cold rolling step and an annealing step (or a plating step) using a steel material which satisfies the component composition described above, and is characterized in proper control of a heat processing pattern particularly at the annealing or plating step to thereby increase generation of polygonal ferrite. The respective steps will be described in their order.

[Hot Rolling Step]

In the present invention, a heating start temperature for hot rolling (SRT) may be an ordinary temperature which may for instance be 1100-1150° C. approximately. There is no particular restriction over other conditions for the hot rolling step: ordinary conditions may be chosen appropriately and implemented. The conditions may specifically be a hot rolling end temperature (FDT) of Ar3 or a higher point, cooling at an average cooling rate of 3-50° C./sec (preferably, approximately 20° C./sec), coiling at a temperature between 500 and 600° C. approximately, etc.

[Cold Rolling Step]

The hot rolling step above is followed by cold rolling, for which a cold rolling rate is not particularly limited. Cold rolling may be carried out under an ordinary condition (at a cold rolling rate of approximately 30-75%). However, for prevention of uneven recrystallization, it is recommended the cold rolling rate is preferably controlled to range from 40% to 70%.

[Annealing Step or Plating Step]

This step is important to finally secure a desired structure (namely, TBF steel which contains residual γ and in which the mother-phase structure is a mixed structure of bainitic ferrite and polygonal ferrite), and the present invention is particularly characterized in properly controlling a soaking temperature (T1 which will be described later), a cooling pattern after soaking and an austemper temperature (T2 which will be described later) to obtain the desired structure.

Specifically, (i) the temperature is retained (soaking) at $A_3$ or a higher point (T1) for 10-200 seconds, (ii) cooling is performed at an average cooling rate (CR1) of 1-10° C./sec or faster temporarily from the temperature T1 down to the temperature Tq expressed by the formula (1) below for transformation of ferrite:

$$A_3-250(^\circ\text{C.})\leq Tq\leq A_3-20(^\circ\text{C.}) \quad (1)$$

(iii) quenching at an average cooling rate (CR2) of 11° C./sec or faster from the temperature Tq down to a bainitic transformation temperature range (T2; about 450-320° C.) while avoiding transformation of ferrite and pearlite, and (iv) keeping in this temperature range (T2) for 180-600 seconds (austemper processing).

First, soaking at the temperature (T1) which is equal to $A_3$ or a higher is effective in completely dissolving carbides and obtaining desired residual γ, and also effective in obtaining the predetermined amount of bainitic ferrite at the cooling step after soaking. Further, the keeping time at the temperature (T1) is preferably 10-200 seconds. If the keeping time is too short, the effect above owing to heating becomes insufficient. On the contrary, if the keeping time is too long, crystal grains become coarse. The keeping time is preferably 20-150 seconds.

This is followed by temporary cooling from the temperature (T1) to the temperature Tq at the average cooling rate (CR1) of 1-10° C./sec or faster, thereby causing transformation of ferrite and growth of polygonal ferrite in bainitic ferrite. If the average cooling rate (CR1) is slower than 1° C./sec, polygonal ferrite is generated in excess (over 50%) during cooling. If the average cooling rate is faster than 11° C./sec however, the amount of polygonal ferrite becomes insufficient (less than 30%).

While the cooling described above needs be performed down to the temperature Tq, if the temperature Tq is too high [over $A_3-20$ (° C.)], a sufficient amount of polygonal ferrite is not obtained. If the temperature Tq is too low, polygonal ferrite is generated in a great amount.

While the method according to the present invention then requires quenching at the average cooling rate (CR2) of 11° C./sec or faster from the temperature Tq (quenching start temperature) down into the bainitic transformation temperature range (T2; about 450-320° C.) while avoiding transformation of ferrite and pearlite, if the average cooling rate CR2 is slower than 11° C./sec, pearlite is generated during quenching and eventually obtained residual γ becomes less. The average cooling rate (CR2) is preferably 15° C./sec or faster, and more preferably, 19° C./sec or faster. The quenching method may be air cooling, mist cooling, cooling of a cooling roll with water, or the like, and with the average cooling rate controlled as described above, the required amount of bainitic ferrite is secured.

The cooling rate (CR2) is controlled down into the bainitic transformation temperature range (T2; about 450-320° C.). This is because if the control is terminated earlier in a higher temperature range than this temperature range (T2) and cooling is performed at an extremely slow rate for instance, it is hard to generate residual γ and it becomes impossible to ensure excellent elongation. Meanwhile, cooling at this cooling rate down to an even lower temperature range is not preferable, either, as such makes it difficult to generate residual γ and ensure excellent elongation.

After this, keeping in the temperature range (T2) for 60-600 seconds is desirable. Keeping of the temperature for 60 seconds or longer promotes efficient condensation of C into residual γ, and hence, realizes stable generation of residual γ in a large amount, whereby residual γ exhibits the TRIP effect without fail. Keeping is preferably for 120 seconds or longer, and more preferably, for 180 seconds or longer. On the contrary, if the keeping time exceeds 600 seconds, residual γ can not fully exhibit the TRIP effect, which is not desirable. The keeping time is preferably 480 seconds or shorter.

In light of an actual operation, it is convenient to perform the annealing processing above using a continuous annealing machine. A technique to use for the thermal treatment above may specifically be heating/cooling which uses a continuous annealing line (CAL, real machine), a continuous alloying/hot dip zincing line (CGL, real machine), a CAL simulator, a salt bath, etc.

A method of quenching down to a normal temperature after keeping at the above temperature is not particularly limited and may be water cooling, gas cooling, air cooling, etc. Further, only to the extent not detrimental to the function of the present invention owing to alteration of the desired metal structure, etc., plating, and further, alloying of the cold-rolled sheet may be performed, and such a steel sheet is also within the scope of the present invention. In the event that the cold-rolled sheet is plated by hot dip zincing, the thermal treatment may be carried out with plating conditions set so as to satisfy the above thermal treatment conditions.

While the present invention will now be described in more detail in relation to examples, the examples below do not restrict the present invention. The present invention may be implemented with appropriate modifications only to the extent meeting the intentions described earlier and below, and any such modification falls under the technical scope of the present invention.

EXAMPLE 1

Consideration on the Components Contained in Steel

In this example, after melting steel grades A through L having the various component compositions shown in Table 1 (the remaining part: Fe and inevitable impurities) and obtaining slabs, the slab was hot-rolled. SRT was controlled at 1150° C. and FDT was controlled at 850° C. during the hot rolling, and winding was performed at 600° C., thereby obtaining a hot-rolled steel sheet having the sheet thickness of 3.0 mm. After acid pickling of thus obtained hot-rolled steel sheet, cold rolling was performed and a cold-rolled steel sheet having the sheet thickness of 2.0 mm was obtained. Listed under "$A_3$ TRANSFORMATION POINT" in Table 1 are values calculated by the formula (3) below:

$$A_3 \text{ transformation point} = 910 - 203(\sqrt{[C]}) + 44.7[Si] - 30[Mn] - 15.2[Ni] + 31.5[Mo] \quad (3)$$

where the symbols [C], [Si], [Mn], [Ni] and [Mo] denote the contents (mass %) of C, Si, Mn, Ni and Me, respectively.

This was followed by a thermal treatment with a CAL simulator. To be specific, after keeping in the temperature range (T1) of 900° C. for 120 seconds, slow cooling was performed at the cooling rate (CR1) of 5° C./sec down to 700° C. (Tq), quenching was initiated from the temperature (Tq) down to 400° C. (T2) at the cooling rate (CR2) of 50° C./sec, keeping was carried out in this temperature range (T2) for about 4 minutes (namely, about 240 seconds), cooling was then performed down to a room temperature, and winding around a coil was executed.

The metal structures of the various steel sheets obtained in this process were calculated by the method above. Besides, a tensile strength test was conducted using JIS test specimen No. 5, which measured the tensile strength (TS), the total elongation (EL) and the uniform elongation (u-EL). Table 2 shows the results together with the balance between the tensile strength and the elongation and the balance between the tensile strength and the uniform elongation.

TABLE 1

| | CHEMICAL COMPONENT COMPOSITION (MASS %) | | | | | | | | A3 TRANSFORMATION |
|---|---|---|---|---|---|---|---|---|---|
| STEEL GRADE | C | Si | Mn | P | S | Al | N | OTHERS | POINT (° C.) |
| A | 0.05 | 1.50 | 1.51 | 0.02 | 0.003 | 0.03 | 0.004 | — | 886 |
| B | 0.11 | 1.51 | 1.50 | 0.02 | 0.003 | 0.03 | 0.004 | — | 865 |
| C | 0.2 | 1.51 | 1.51 | 0.02 | 0.003 | 0.03 | 0.004 | — | 841 |
| D | 0.2 | 0.51 | 1.51 | 0.02 | 0.003 | 0.03 | 0.004 | — | 797 |
| E | 0.2 | 1.51 | 3.51 | 0.02 | 0.003 | 0.03 | 0.004 | — | 781 |
| F | 0.2 | 1.51 | 1.51 | 0.02 | 0.003 | 0.03 | 0.004 | Mo: 0.2 | 848 |
| G | 0.2 | 1.51 | 1.51 | 0.02 | 0.003 | 0.03 | 0.004 | Nb: 0.05 | 841 |
| H | 0.2 | 1.51 | 1.51 | 0.02 | 0.003 | 0.03 | 0.004 | Ni: 0.2 | 838 |
| I | 0.2 | 1.51 | 1.51 | 0.02 | 0.003 | 0.03 | 0.004 | Cu: 0.2 | 841 |
| J | 0.2 | 1.51 | 1.51 | 0.02 | 0.003 | 0.03 | 0.004 | Ti: 0.05 | 841 |
| K | 0.2 | 1.51 | 1.51 | 0.02 | 0.003 | 0.03 | 0.004 | V: 0.05 | 841 |

TABLE 2

| | | STRUCTURE | | | | PROPERTY | | | | |
|---|---|---|---|---|---|---|---|---|---|---|
| No. | STEEL GRADE | PF (AREA %) | NON-PF (AREA %) | RESIDUAL γ (AREA %) | BF (VOLUME %) | TS (MPa) | EL (%) | TS × EL | u-EL (%) | TS × u-EL |
| 1 | A | 98 | 2 | 1 | 1 | 581 | 33 | 19347 | 22 | 12576 |
| 2 | B | 45 | 55 | 7 | 48 | 668 | 39 | 26052 | 25 | 16934 |
| 3 | C | 43 | 57 | 13 | 44 | 777 | 30 | 23310 | 20 | 15152 |
| 4 | D | 37 | 63 | 1 | 62 | 840 | 17 | 13860 | 11 | 9009 |
| 5 | E | — | — | — | — | — | — | — | — | — |
| 6 | F | 34 | 66 | 9 | 57 | 859 | 27 | 23021 | 17 | 14964 |

TABLE 2-continued

| No. | STEEL GRADE | STRUCTURE PF (AREA %) | NON-PF (AREA %) | RESIDUAL γ (AREA %) | BF (VOLUME %) | PROPERTY TS (MPa) | EL (%) | TS × EL | u-EL (%) | TS × u-EL |
|---|---|---|---|---|---|---|---|---|---|---|
| 7 | G | 45 | 55 | 14 | 41 | 787 | 31 | 24397 | 20 | 15858 |
| 8 | H | 37 | 63 | 15 | 48 | 790 | 32 | 25280 | 21 | 16432 |
| 9 | I | 38 | 62 | 16 | 46 | 809 | 31 | 25079 | 20 | 16301 |
| 10 | J | 43 | 57 | 13 | 44 | 825 | 28 | 23100 | 18 | 15015 |
| 11 | K | 43 | 57 | 13 | 43 | 807 | 29 | 23403 | 19 | 15212 |

An observation from Tables 1 and 2 is as follows. First, indicated in Table 2 as Nos. 2, 3, 6-11 are all cold-rolled steel sheets thermally treated under the conditions specified in the present invention using steel materials satisfying the components in steel specified in the present invention (namely, steel grades indicated at Nos. B, C, F-K in Table 1), and extremely excellent with respect to the balance between the tensile strength and the elongation and the balance between the tensile strength and the uniform elongation. In contrast, the following samples lacking any one of the requirements specified in the present invention have defects described below.

Of these, the one indicated as No. 1 is a sample using the steel grade A containing a small amount of C, which failed to sufficiently secure the predetermined amount of residual γ, resulted in a structure which contained less bainitic ferrite and was mainly consisted of polygonal ferrite, and therefore, failed to secure the tensile strength.

The one indicated as No. 4 is a sample using the steel grade D containing a small amount of Si, which failed to sufficiently secure the predetermined amount of residual γ and exhibited a deteriorated balance between the tensile strength and the elongation and a deteriorated balance between the tensile strength and the uniform elongation. The one indicated as No. 5 is a sample using the steel grade E containing a large amount of Mn, which gave rise to cracks during hot rolling (and therefore was not evaluated after that).

EXAMPLE 2

Consideration on the Thermal Treatment Conditions

This example relates to study of the influence over the structures, the mechanical properties and the like of cold-rolled steel sheets (Nos. 12-19) which were manufactured using the steel grade C (which is the steel grade satisfying the range according to the present invention) shown in Table 2 by the manufacturing method according to Example 1 with some of the annealing conditions off the requirements according to the present invention. The annealing conditions in this example are as shown in Table 3. The other conditions (namely, the hot rolling conditions and the cold rolling conditions) are as described in relation to Example 1.

Table 4 shows the results. For reference, Tables 3 and 4 also show the result on No. 3 of Table 2 and include a sample which was obtained by plating this (No. 20).

TABLE 3

| No. | STEEL GRADE | ANNEALING CONDITIONS HEATING TEMPREATURE T1 (° C.) | AVERAGE COOLING RATE CR1 (° C./sec) | QUENCHING START TEMPREATURE Tq (° C.) | AVERAGE COOLING RATE CR2 (° C./sec) | AUSTEMPER TEMPERATURE (° C.) | PLATING |
|---|---|---|---|---|---|---|---|
| 3 | C | 900 | 5 | 700 | 20 | 400 | NOT PLATED |
| 12 | C | 800 | 1 | 700 | 20 | 400 | NOT PLATED |
| 13 | C | 900 | 0.5 | 700 | 20 | 400 | NOT PLATED |
| 14 | C | 900 | 20 | 700 | 20 | 400 | NOT PLATED |
| 15 | C | 900 | 5 | 830 | 20 | 400 | NOT PLATED |
| 16 | C | 900 | 5 | 540 | 20 | 400 | NOT PLATED |
| 17 | C | 900 | 5 | 700 | 5 | 400 | NOT PLATED |
| 18 | C | 900 | 5 | 700 | 20 | 600 | NOT PLATED |
| 19 | C | 900 | 5 | 700 | 20 | 300 | NOT PLATED |
| 20 | C | 900 | 5 | 700 | 20 | 400 | PLATED |

TABLE 4

| No. | STEEL GRADE | STRUCTURE PF (AREA %) | NON-PF (AREA %) | RESIDUAL γ (AREA %) | BF (AREA %) | OTHERS (AREA %) | PROPERTY TS (MPa) | EL (%) | TS × EL | u-EL (%) | TS × u-EL |
|---|---|---|---|---|---|---|---|---|---|---|---|
| 3 | C | 43 | 57 | 13 | 44 | 0 | 777 | 30 | 23310 | 20 | 15152 |
| 12 | C | 69 | 31 | 9 | 22 | 0 | 645 | 34 | 21930 | 26 | 16448 |
| 13 | C | 65 | 35 | 11 | 24 | 0 | 675 | 33 | 22275 | 22 | 14924 |
| 14 | C | 23 | 77 | 13 | 64 | 0 | 797 | 29 | 23113 | 17 | 13868 |
| 15 | C | 8 | 92 | 14 | 78 | 0 | 799 | 24 | 19176 | 16 | 12464 |
| 16 | C | 72 | 28 | 10 | 18 | 0 | 640 | 35 | 22400 | 23 | 15008 |
| 17 | C | 50 | 35 | 1 | 34 | P: 15 | 727 | 20 | 14540 | 13 | 9451 |
| 18 | C | 60 | 40 | 3 | 37 | 0 | 623 | 35 | 21805 | 25 | 15264 |

TABLE 4-continued

| | | STRUCTURE | | | | | PROPERTY | | | | |
|---|---|---|---|---|---|---|---|---|---|---|---|
| No. | STEEL GRADE | PF (AREA %) | NON-PF (AREA %) | RESIDUAL γ (AREA %) | BF (AREA %) | OTHERS (AREA %) | TS (MPa) | EL (%) | TS × EL | u-EL (%) | TS × u-EL |
| 19 | C | 44 | 56 | 2 | 54 | 0 | 787 | 26 | 20462 | 17 | 13300 |
| 20 | C | 42 | 58 | 13 | 45 | 0 | 778 | 30 | 23340 | 20 | 15171 |

An observation from Tables 3 and 4 is as follows. First, the one indicated as No. 12 is a sample for which the heating temperature (T1; soaking temperature) was lowered (below the $A_3$ transformation point), and contained more polygonal ferrite than the amount it contained at the initial stage of the thermal treatment. Further, due to cooling from the 2-phase (α+γ) equilibrium state, ferrite transformation rapidly progressed and the space factor of polygonal ferrite increased, which made it impossible to obtain the desired strength.

The reason why the structure changes when the heating temperature T1 decreases even though the quenching start temperature Tq remains unchanged may be as follows. That is, while chemical driving force (a temperature difference ΔT in the event of excessive cooling) is necessary for crystal nucleation of bainitic ferrite, since the cooling start temperature (namely, the heating temperature T1) at the beginning is low for the sample No. 12, the driving force is not obtained during cooling, and therefore, a sufficient amount of bainitic ferrite is not obtained. While cooling proceeds, C atoms diffuse (with ferrite transformation being diffusing transformation), which causes growth of polygonal ferrite.

On the sample No. 13, the cooling rate (CR1) was slow and polygonal ferrite was generated in excess during cooling, which made it impossible to obtain the desired tensile strength and degraded the balance between the tensile strength and the elongation.

On the sample No. 14, the cooling rate (CR1) was slow and polygonal ferrite was not generated in a sufficient amount, which discouraged uniform elongation and degraded the balance between the tensile strength and the uniform elongation.

On the sample No. 15, as the quenching start temperature (Tq) was high [$A_3$−11(° C.)], polygonal ferrite was not generated in a sufficient amount, which constrained elongation and uniform elongation and degraded the balance between the tensile strength and the elongation and uniform elongation and degraded the balance between the tensile strength and the uniform elongation.

On the sample No. 16, the quenching start temperature (Tq) was low [$A_3$−301(° C.)] and polygonal ferrite was generated in a great amount (while reducing the amount of bainitic ferrite), which lowered the tensile strength and degraded the balance between the tensile strength and the elongation.

On the sample No. 17, as the cooling rate (CR2) was slow, pearlite was generated and eventually obtained residual γ became less, and therefore, it was not possible to see favorable elongation and uniform elongation, and the balance between the tensile strength and the elongation and uniform elongation and degraded the balance between the tensile strength and the uniform elongation deteriorated.

On the sample No. 18, the austemper temperature was high (600° C.) and polygonal ferrite was generated in a great amount (while reducing the amount of bainitic ferrite), which lowered the tensile strength and degraded the balance between the tensile strength and the elongation.

On the sample No. 19, the austemper temperature was low (300° C.) and residual γ reduced, which made it impossible to see favorable elongation and uniform elongation and degraded the balance between the tensile strength and the elongation and the balance between the tensile strength and the uniform elongation.

The invention claimed is:

1. A high-strength cold-rolled steel sheet excellent in uniform elongation, comprising in percent by mass (which is hereinafter applied similarly to chemical components):

0.10-0.28% of C;

1.0-2.0% of Si; and 1.0-3.0% of Mn, wherein the structure of the high-strength cold-rolled steel sheet is:

40-65% of bainitic ferrite;

30-50% of polygonal ferrite; and 9-17% of residual austenite;

and wherein the product of its tensile strength (TS) in MPa and total elongation (EL) in % (TS×L) is 23,000 or more.

2. A high-strength cold-rolled steel sheet according to claim 1, further comprising, as other element, at least one element selected from a group consisting of:

0.10% or less (not including 0%) of Nb;

1.0% or less (not including 0%) of Mo;

0.5% or less (not including 0%) of Ni; and 0.5% or less (not including 0%) of Cu.

3. A high-strength cold-rolled steel sheet according to claim 1, further comprising, as other element, 0.003% or less (not including 0%) of Ca and/or 0.003% or less (not including 0%) of REM.

4. A high-strength cold-rolled steel sheet according to claim 1, further comprising, as other element, 0.1% or less (not including 0%) of Ti and/or 0.1% or less (not including 0%) of V.

5. A high-strength cold-rolled steel sheet excellent in uniform elongation of claim 1, wherein the structure of the high-strength cold-rolled steel sheet is:

40-65% of bainitic ferrite;

30-50% of polygonal ferrite;

9-16% of residual austenite; and less than 5% of martensite.

6. A high-strength cold-rolled steel sheet excellent in uniform elongation of claim 1, wherein the structure of the high-strength cold-rolled steel sheet is:

40-65% of bainitic ferrite;

30-50% of polygonal ferrite;

9-15% of residual austenite; and less than 5% of martensite.

7. A high-strength cold-rolled steel sheet excellent in uniform elongation of claim 1, wherein the structure of the high-strength cold-rolled steel sheet is:

40-65% of bainitic ferrite;

30-50% of polygonal ferrite;

9-14% of residual austenite; and less than 5% of martensite.

8. A high-strength cold-rolled steel sheet excellent in uniform elongation of claim 1, having a cold rolled thickness of less than 3 mm.

9. A high-strength cold-rolled steel sheet excellent in uniform elongation of claim 1, wherein the total amount of pearlite, bainite and martensite is 5% or less.

10. A high-strength cold-rolled steel sheet excellent in uniform elongation, comprising in percent by mass (which is hereinafter applied similarly to chemical components):

0.10-0.28% of C;

1.0-2.0% of Si; and 1.0-3.0% of Mn, wherein the structure of the high-strength cold-rolled steel sheet is:

40-65% of bainitic ferrite;

30-50% of polygonal ferrite; and 9-17% of residual austenite;

wherein the product of its tensile strength (TS) in MPa and total elongation (EL) in % (TS×EL) is 23,000 or more, and the product of its tensile strength (TS) in MPa and uniform elongation (u-EL) in % (TS×u-EL) is 14,700 or more; and wherein the cold-rolled steel sheet is produced by a method comprising:

(a) hot rolling the steel sheet, (b) cold rolling the hot rolled steel sheet, (c) heating the cold rolled steel sheet to a temperature which is equal to or higher than the $A_3$ transformation point ($A_3$), and cooling the heated steel sheet at an average cooling rate of 1-10° C./sec to a temperature Tq, expressed by the formula (1) below $$A_3-250(°\,C.)<Tq<A_3-20(°\,C.) \quad (1),$$

and then (d) quenching the cooled steel sheet down into a bainitic transformation temperature range at an average cooling rate of 11° C./sec or faster.

11. A high-strength cold-rolled steel sheet excellent in uniform elongation of claim 10, wherein the structure of the high-strength cold-rolled steel sheet is:

40-65% of bainitic ferrite;

30-50% of polygonal ferrite;

9-16% of residual austenite; and less than 5% of martensite.

12. A high-strength cold-rolled steel sheet excellent in uniform elongation of claim 10, wherein the structure of the high-strength cold-rolled steel sheet is:

40-65% of bainitic ferrite;

30-50% of polygonal ferrite;

9-15% of residual austenite; and less than 5% of martensite.

13. A high-strength cold-rolled steel sheet excellent in uniform elongation of claim 10, wherein the structure of the high-strength cold-rolled steel sheet is:

40-65% of bainitic ferrite;

30-50% of polygonal ferrite;

9-14% of residual austenite; and less than 5% of martensite.

14. A high-strength cold-rolled steel sheet excellent in uniform elongation of claim 10, having a cold rolled thickness of less than 3 mm.

15. A high-strength cold-rolled steel sheet excellent in uniform elongation of claim 10, wherein the total amount of pearlite, bainite and martensite is 5% or less.

* * * * *